United States Patent [19]

Tsuchikawa et al.

[11] Patent Number: 4,539,943

[45] Date of Patent: Sep. 10, 1985

[54] ENGINE COOLING SYSTEM

[75] Inventors: Shunzo Tsuchikawa; Yasuhiro Kawabata, both of Kariya, Japan

[73] Assignee: Aisin Seiki Kabushiki Kaisha, Kariya, Japan

[21] Appl. No.: 639,224

[22] Filed: Aug. 9, 1984

[30] Foreign Application Priority Data

| | | | |
|---|---|---|---|
| Sep. 20, 1983 | [JP] | Japan | 58-172255 |
| Sep. 20, 1983 | [JP] | Japan | 58-172256 |
| Sep. 20, 1983 | [JP] | Japan | 58-172257 |

[51] Int. Cl.[3] ..... F01P 5/04; F01P 11/10

[52] U.S. Cl. ..... 123/41.05; 123/41.12

[58] Field of Search ..... 123/41.04, 41.05, 41.06, 123/41.11, 41.12, 41.49; 180/54 A

[56] References Cited

U.S. PATENT DOCUMENTS

| | | | |
|---|---|---|---|
| 2,913,065 | 11/1959 | Lyon, Jr. | 123/41.06 |
| 3,398,882 | 8/1968 | Zenkner | 230/125 |
| 4,065,052 | 12/1977 | Ridenour | 123/41.12 |
| 4,366,783 | 1/1983 | Clemente | 123/41.12 |
| 4,376,424 | 3/1983 | Mazur | 123/41.12 |
| 4,438,732 | 3/1984 | Seifert | 123/41.05 |
| 4,489,680 | 12/1984 | Spokas et al. | 123/41.49 |

*Primary Examiner*—William A. Cuchlinski, Jr.

*Attorney, Agent, or Firm*—Finnegan, Henderson, Farabow, Garrett & Dunner

[57] ABSTRACT

An engine cooling system has a cross-flow fan disposed transversely in a car body between a radiator and an engine having a rotatable shaft coupled to and driven by a hydraulic motor which is actuated by an engine-operated hydraulic pump. The hydraulic pump and the hydraulic motor are interconnected by supply and return passages, the supply passage having a directional control valve for selectively connecting the supply passage to the return passage in bypassing relation to the hydraulic motor to interrupt operation of the fan. A second directional control valve is connected parallel to the first-mentioned directional control valve for selectively connecting the supply passage to the return passage in bypassing relation to the hydraulic motor. Hydraulic cylinders are respectively controlled by these first and second directional control valves for respectively actuating a radiator shutter and a movable shroud. A fluid coupling is operatively connected between the hydraulic pump and the output shaft of an engine for controlling a maximum number of rpm of the hydraulic pump to thereby keep an amount of oil discharged from the hydraulic pump below a certain level when the engine rotates at a high speed.

10 Claims, 8 Drawing Figures

ENGINE COOLING SYSTEM

BACKGROUND OF THE INVENTION

1. Field of the Invention

The present invention relates to an engine cooling system for cooling an angine on an automobile.

2. Description of the Prior Art

There are known two principal types of engine cooling systems for cars, one using water and the other using air as a cooling medium. The water-cooled engine has a radiator in which cooling water flows that is cooled by air forcibly passed through the radiator. An axial-flow fan or a cross-flow fan is employed for forcibly supplying air to the radiator. Although the axial-flow fan produces a stream of air having a cross-sectionally circular pattern, the cross-flow fan can be disposed transversely of the car and hence can supply a uniform stream of air to the entire front surface of the radiator. Therefore, the cross-flow fan is suitable for use in a long-nosed car of a reduced height.

Conventional engine cooling systems incorporating cross-flow fans are disclosed in Japanese Laid-Open Patent Publication Nos. 54-110519 and 57-163118. The disclosed engine cooling systems employ the torque produced by an electric motor or an engine as a source of power for the cross-flow fan. Where the electric motor is used, the battery and the alternator are subjected to an increased load which adversely affects other electronic accessories, or the battery should be large in capacity. In a case where the torque of the engine is transmitted by a belt to the cross-flow fan, on the other hand, the fan coupled to the engine and a cross-flow fan casing mounted on the car body are likely to contact each other due to their different cycles of vibration. In addition, the crank shaft of the engine poses a limitation on the position at which the cross-flow fan can be installed.

SUMMARY OF THE INVENTION

It is an object of the present invention to provide an engine cooling system which will eliminate the aforementioned shortcomings encountered in the prior art.

Another object of the present invention is to provide an engine cooling system having a cross-flow fan driven by a hydraulic motor actuated by an engine-operated hydraulic pump.

Additional objects and advantages of the invention will be set forth in the description which follows, and in part will be obvious from the description, or may be learned by practice of the invention. The objects and advantages of the invention may be realized and attained by means of the instrumenalities and combinations particularly pointed out in the appended claims.

According to the present invention, a cross-flow fan disposed transversely in a car body between a radiator and an engine has a rotatable shaft coupled to and driven by a hydraulic motor which is actuated by an engine-operated hydraulic pump. The hydraulic pump and the hydraulic motor are interconnected by supply and return passages, the supply passage having a directional control valve for selectively connecting the supply passage to the return passage in bypassing relation to the hydraulic motor. The hydraulic pump may double as a lubricating oil pump, so that the invention is applicable to existing engine cooling systems. Various types of cross-flow fans may be used by selecting the capacity of the hydraulic motor. A second directional control valve is connected parallel to the first-mentioned directional control valve for selectively connecting the supply passage to the return passage in bypassing relation to the hydraulic motor. Between the supply and return passages, there are connected hydraulic cylinders controlled by first and second directional control valves for actuating a radiator shutter and a movable shroud. This arrangement which includes a section of the supply passage running forward or backward of the cross-flow fan or radiator, allows oil discharged from the hydraulic pump to be controlled in temperature by the cross-flow fan, there being no need for an oil cooler. According to still another embodiment, a fluid coupling is operatively connected between the hydraulic pump and the output shaft of an engine for controlling a maximum rpm of the hydraulic pump to thereby keep an amount of oil discharged from the hydraulic pump below a certain level when the engine rotates at a high speed. Therefore, the cross-flow fan is rotated at an rpm below a constant value to prevent the engine from being excessively cooled. In consequence, the hydraulic motor may be of such a capacity that the cross-flow fan can supply a desired amount of cooling air when the temperature of engine cooling water is high and the engine is idling, and still no excessive amount of air is fed to the engine while the engine is rotating at high speed.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
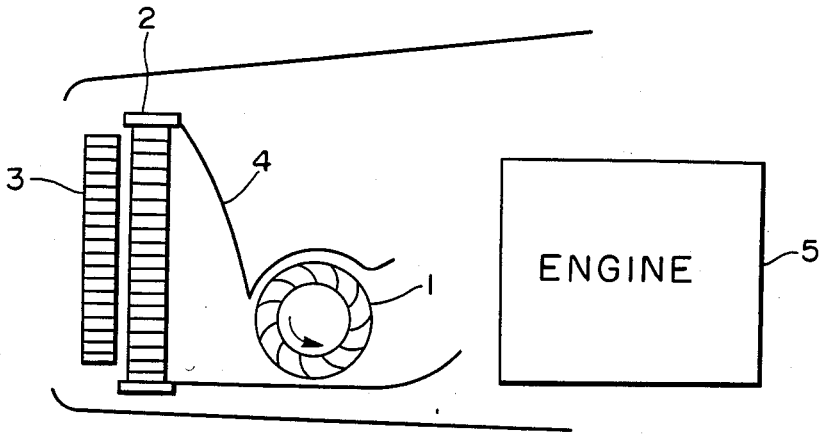
FIG. 1 is a schematic side elevational view of an engine cooling system according to an embodiment of the present invention.

Identical reference characters denote identical or equivalent components throughout the several views.

As shown in FIG. 1, a cross-flow fan 1 is disposed transversely in a car body and preceded by a radiator 2 and/or an air conditioning condenser 3. Air having passed through the radiator 2 is guided by a shroud 4 toward the cross-flow fan, which forcibly supplies air to an engine 5.

Figure 2:
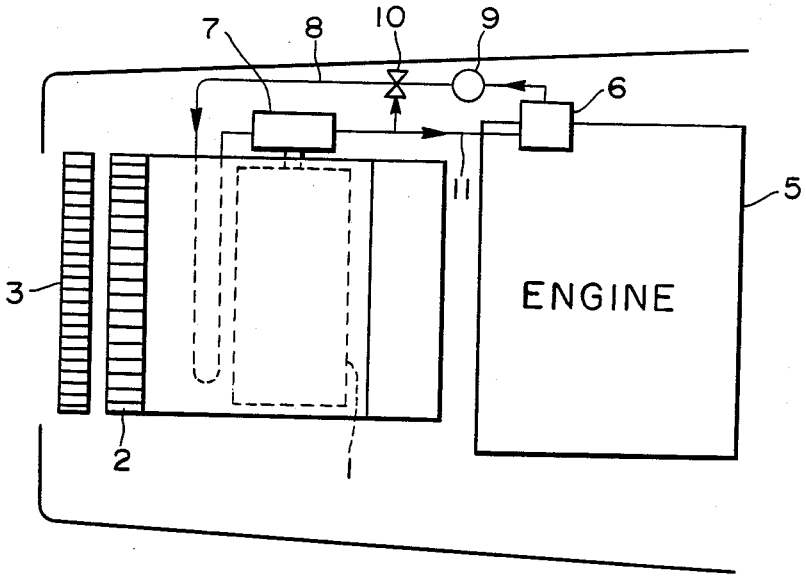
FIG. 2 is a schematic plan view of the engine cooling system shown in FIG. 1.

FIG. 2 shows a driving circuit of the engine cooling system illustrated in FIG. 1. A hydraulic pump 6 driven by the output shaft of the engine 5 is connected to a hydraulic motor 7 coupled to the shaft of the cross-flow fan 1 so that return oil from the hydraulic motor 7 will flow back to the hydraulic pump 6 through a return passage 11. The hydraulic pump 6 is also connected to the hydraulic motor 7 through a supply passage 8 having an oil filter 9 and a directional control valve 10. The directional control valve 10 selectively connects the supply passage 8 to the return passage 11 in bypassing relation to the hydraulic motor 7 so that no oil will be fed to the hydraulic motor 7. The supply passage 8 is positioned forward or backward of the cross-flow fan 1 or the radiator 2 and the condenser 3 and extends transversely of the car body for cooling oil flowing therethrough.

Figure 3:
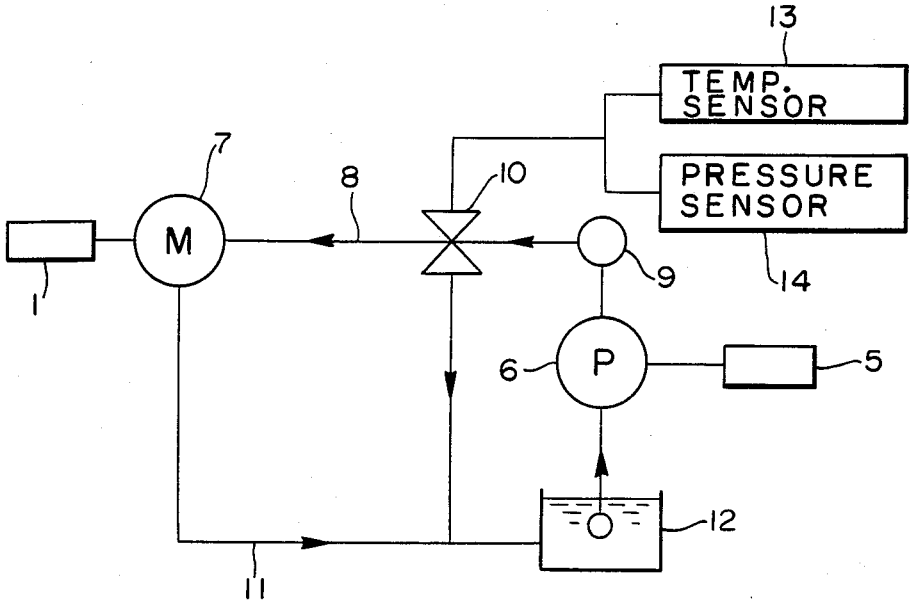
FIG. 3 is a block diagram of a driving circuit of an engine cooling system according to another embodiment of the present invention.

According to an embodiment shown in FIG. 3, oil from the hydraulic motor 7 is once returned to an oil pan or oil tank 12, from which oil can be supplied by the hydraulic motor 7. The directional control valve 10 is controlled in response to signals from a cooling-water temperature sensor 13 and a compressor high-pressure sensor 14 for drawing air at a rate dependent on the engine temperature. More specifically, when the engine 5 is cooled, the directional control valve 10 is opened to connect the supply passage 8 from the hydraulic pump 6 to the return passage 11 from the hydraulic motor 7 to thereby interrupt rotation of the cross-flow fan 1.

Figure 4:
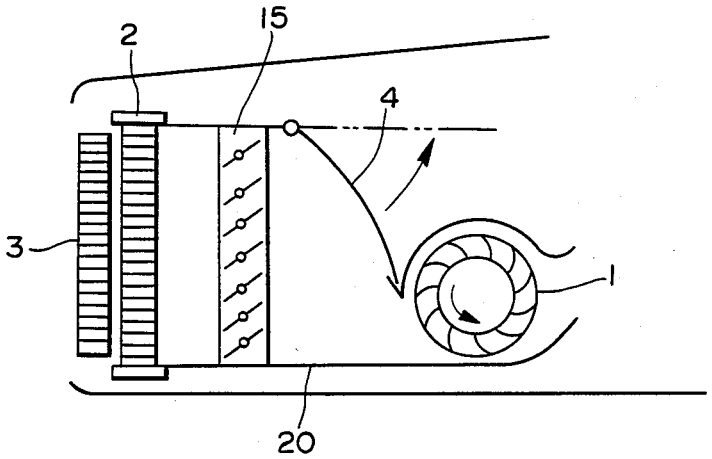
FIG. 4 is a schematic side elevational view of an engine cooling system according to still another embodiment of the present invention.
Figure 5:
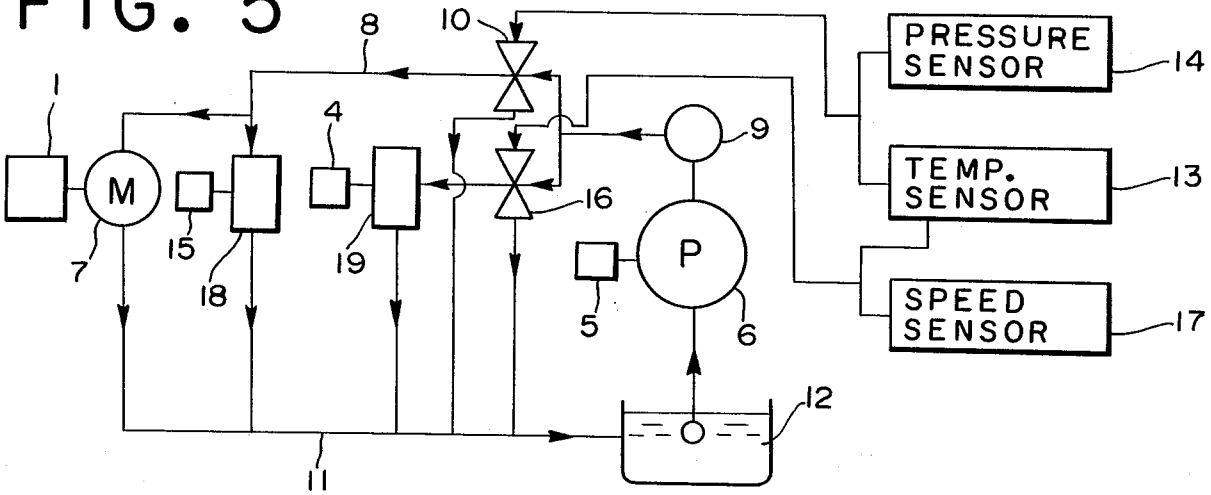
FIG. 5 is a block diagram of a driving circuit of the engine cooling system of FIG. 2.

FIG. 4 shows an engine cooling system of still another embodiment in which a radiator shutter 15 and a shroud 4 are movable, the engine cooling system having a driving circuit shown in FIG. 5. The supply passage 8 from the hydraulic pump 6 to the hydraulic motor 7 has a first directional control valve 10 controlled by signals from the temperature sensor 13 and the compressor high-pressure sensor 14. A second directional control valve 16 is connected to the filter 9 in parallel relation to the first directional control valve 10. The second directional control valve 16 is controlled by signals from the temperature sensor 13 and a car speed sensor 17. The first directional control valve 10 is connected to the hydraulic motor 7 and a hydraulic cylinder 18 for actuating the radiator shutter 15, which is disposed between the radiator 2 and the cross-flow fan 1. The first directional control valve 10 is also coupled to the return passage 11 for selectively connecting the hydraulic pump 6 to the oil tank 12 in bypassing relation to the hydraulic motor 7. The second directional control valve 16 is connected to a hydraulic cylinder 19 for actuating the movable shroud 4. Operation of the engine cooling system of FIGS. 4 and 5 is as follows: When the water temperature and the compressor pressure are high, the cross-flow fan 1 is actuated and the radiator shutter 15 is opened. When the water temperature and the compressor pressure are low, the supply passage 8 is connected by the first directional control valve 10 to the return passage 11 to render the cross-flow fan 1 inoperative and close the radiator shutter 15 to thereby cut off air supply to the engine. When the car speed is low and the water temperature of the radiator is high, oil from the hydraulic pump 6 is supplied by the second directional control valve 16 to the hydraulic cylinder 19 to close the shroud 4 to the position of FIG. 4, and the cross-flow fan 1 is actuated and the radiator shutter 5 is opened to feed cooling air to the engine. When the car speed is high, the shroud 4 is opened in the direction of the arrow (FIG. 4), the radiator shutter 15 is opened, and the cross-flow fan 1 is inactivated, so that only air as it is introduced through the radiator 3 is fed to the engine.

As illustrated in FIG. 4, the movable shroud 4, as it is closed, has a lower end positioned in front of the cross-flow fan 1 adjacent to a horizontal plane passing through the central axis of the cross-flow fan 1. When the movable shroud 4 is opened, it is moved upwardly in the direction of the arrow. A lower shroud 20 is disposed below the movable shroud 4 and extends parallel to the horizontal plane passing through the central axis of the cross-flow fan 1. With the shrouds 4, 20 thus positioned as illustrated in FIG. 4, the cross-flow fan 1 is rotated counterclockwise during operation so as to reduce resistance by air to the rotation of the cross-flow fan 1 and increase the efficiency at which the cross-flow fan 1 feeds air.

Figure 6:
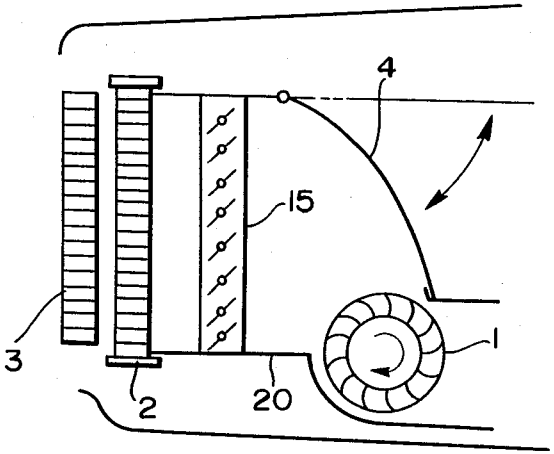
FIG. 6 is a schematic side elevational view of a modification of the engine cooling system illustrated in FIG. 4, showing a different shroud.

FIG. 6 shows a modification of the arrangement of FIG. 4, in which a lower shroud 20 has a front portion extending adjacent to the horizontal plane passing through the central axis of the cross-flow fan 1, and a movable shroud 4 has a lower end positioned approximately rearward of the cross-flow fan 1. In operation, the cross-flow fan 1 is rotated clockwise as shown.

Figure 7:
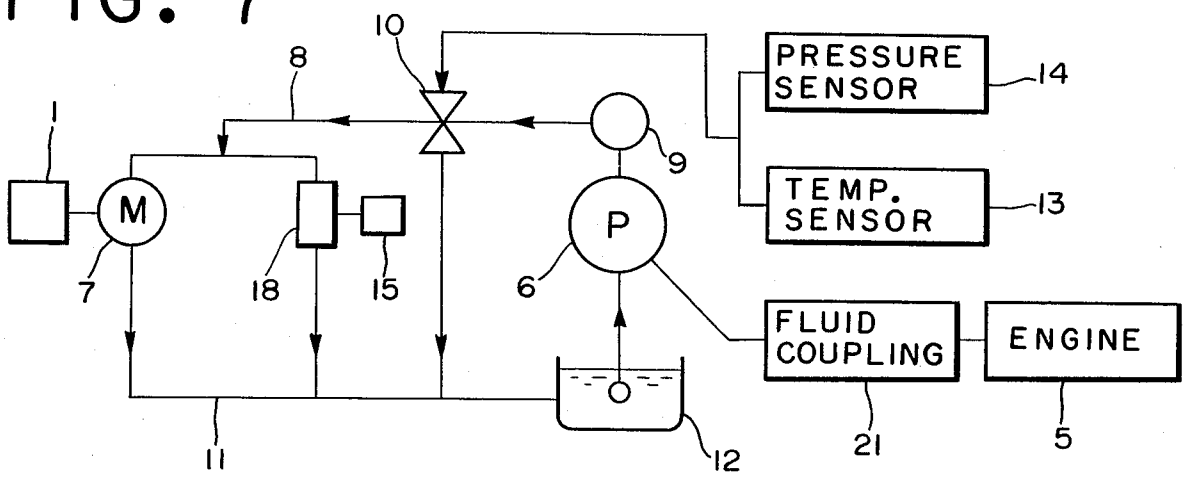
FIG. 7 is a block diagram of a driving circuit of an engine cooling system according to a still further embodiment of the present invention.
Figure 8:
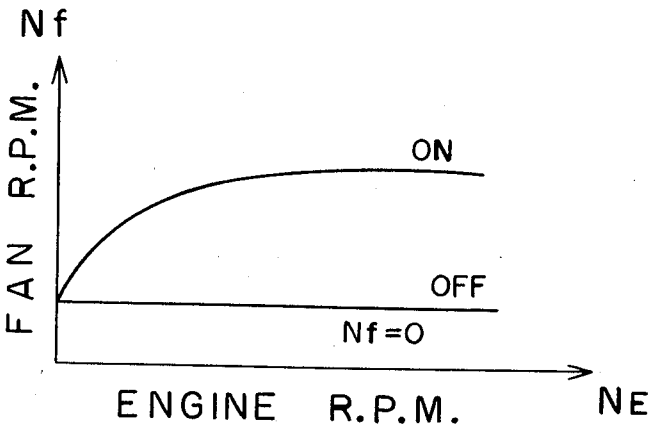
FIG. 8 is a graph illustrative of the relationship between engine r.p.m and cross-flow fan r.p.m.

It is sometimes necessary to reduce the number of rpm of the cross-flow fan 1 to prevent the engine 5 from being excessively cooled even when the number of rpm of the engine 5 is large, or to maintain the number of rpm of the cross-flow fan 1 as large as possible when the engine temperature is high even if the number of rpm of the engine is low (such as during idling). To meet such a requirement, a fluid coupling 21 is operatively coupled between the output shaft of the engine 5 and the hydraulic pump 6, as shown in FIG. 7. When the number of rpm of the engine 5 is increased beyond a certain value, the fluid coupling 21 slips to keep the maximum number of rpm of the hydraulic pump 6 below a certain level. The fluid coupling 21 ensures a good efficiency of torque transmission while the number of rpm of the engine 5 is low. As a result, the number (Nf) of rpm of the cross-flow fan 1 and the number ($N_E$) of rpm of the engine 5 have the relationship as shown in FIG. 8. FIG. 8 indicates that when the number of rpm of the engine is high, the number of rpm of the cross-flow fan is kept from going higher than a certain value; and when the number of rpm of the engine is small, the cross-flow fan rotates at a minimum required number of rpm. Except for the hydraulic cylinder 18, the radiator shutter 15 and the fluid coupling 21, the engine cooling system of FIG. 7 is substantially the same in construction as the engine cooling system shown in FIG. 3, and hence operation thereof will not be described. Instead of the fluid coupling 21, a variable-displacement hyraulic pump 6 may be used for discharging oil at a rate which is not in linear proportion to the number of rpm of the engine 5.

An additional electric motor may be coupled with the cross-flow fan 1 for ensuring a desired number of rpm of the cross-flow fan 1 by actuating the additional motor only at the time the number of rpm of the engine 5 is low and the engine temperature is high. When the additional motor is energized, a larger amount of cooling air can be supplied to the engine than possible otherwise. The energization of the additional motor consumes only a small amount of energy and, hence, does not adversely affect other electronic accessories to the engine and does not require a battery and an alternator which are of larger capacity.

Rather than employing the additional motor, the hydraulic motor can be of such a capacity that the cross-flow fan can supply desired cooling air when the engine cooling water is of a high temperature and the engine is idling. With such an arrangement, the engine operating at high rpm can be prevented from being excessively cooled by the fluid coupling which prevents air from being directed to the engine at an excessive rate.

Although certain preferred embodiments have been shown and described, it should be understood that many changes and modifications may be made therein without departing from the scope of the appended claims.

What is claimed is:

1. An engine cooling system for use in an automobile, comprising:

(a) an engine having an output shaft;
(b) a radiator;
(c) a cross-flow fan disposed adjacent to said radiator and having a rotatable shaft;
(d) a hydraulic motor coupled to said rotatable shaft of said cross-flow fan;
(e) a hydraulic pump driven by said output shaft of the engine and connected to said hydraulic motor for supplying oil under pressure to the hydraulic motor to rotate said rotatable shaft of the cross-flow fan;
(f) a return passage interconnecting said hydraulic motor and said hydraulic pump;
(g) a supply passage interconnecting said hydraulic pump and said hydraulic motor;
(h) a directional control valve disposed in said supply passage for selectively connecting said supply passage to said return passage in bypassing relation to said hydraulic motor;
(i) a temperature sensor for sensing the temperature of engine cooling water, said directional control valve being controlled by a signal from said temperature sensor;
(j) a second directional control valve connected parallel to said first-mentioned directional control valve for selectively connecting said supply passage to said return passage;
(k) a movable shroud for controlling a flow of air toward said cross-flow fan;
(l) a radiator shutter disposed between said radiator and said cross-flow fan; and
(m) hydraulic means connected between said supply passage and said return passage for actuating said radiator shutter and said movable shroud, respectively.

2. An engine cooling system according to claim 1, wherein said second directional control valve is controlled by a signal from said temperature sensor.

3. An engine cooling system according to claim 1, further including a speed sensor for sensing the speed of the automobile, said second directional control valve being controlled by a signal from said speed sensor.

4. An engine cooling system according to claim 1, further including a fluid coupling operatively connected between said output shaft of the engine and said hydraulic pump for controlling a maximum number of rpm of said hydraulic pump.

5. An engine cooling system for use in an automobile comprising:

(a) an engine having an output shaft;
(b) a radiator;
(c) a cross-flow fan disposed between said radiator and said engine, said fan having a rotatable shaft;
(d) a hydraulic motor coupled to said rotatable shaft of said cross-flow fan;
(e) a hydraulic pump driven by said output shaft of the engine and connected to said hydraulic motor for supplying oil under pressure to the hydraulic motor to rotate said rotatable shaft of the cross-flow fan;
(f) a return passage interconnecting said hydraulic motor and said hydraulic pump;
(g) a supply passage interconnecting said hydraulic pump and said hydraulic motor;
(h) a radiator shutter disposed between said radiator and said cross-flow fan;
(i) hydraulic means connected between said supply passage and said return passage for actuating said radiator shutter, and
(j) a directional control valve disposed in said supply passage for selectively connecting said supply passage to said return passage in bypassing relation to said hydraulic motor and said hydraulic means to interrupt operation of said hydraulic motor and close said radiator shutter.

6. An engine cooling system according to claim 5, in which a part of said supply passage is interposed between said radiator and said fan for cooling the oil passing through said supply passage.

7. An engine cooling system according to claim 6, in which a fluid coupling is operatively connected between said output shaft of the engine and said hydraulic means.

8. An engine cooling system for use in an automobile comprising:

(a) an engine having an output shaft;
(b) a radiator;
(c) a cross-flow fan disposed adjacent to said radiator and having a rotatable shaft;
(d) a hydraulic motor coupled to said rotatable shaft of the cross-flow fan;
(e) a hydraulic pump driven by said output shaft of the engine and connected to said hydraulic motor for supplying oil under pressure to the hydraulic motor to rotate said rotatable shaft of the cross-flow fan;
(f) a return passage interconnecting said hydraulic motor and said hydraulic pump;
(g) a supply passage interconnecting said hydraulic pump and said hydraulic motor;
(h) a directional control valve disposed in said supply passage for selectively connecting said supply passage to said return passage in bypassing relation to said hydraulic motor and interrupting operation of said hydraulic pump;
(i) a movable shroud for controlling a flow of air toward said cross-flow fan;
(j) hydraulic means connected to said supply passage for actuating said movable shroud; and
(k) a second directional control valve connected in parallel to said first mentioned directional control valve for selectively connecting said supply passage to said return passage for interrupting operation of said hydraulic means.

9. An engine cooling system according to claim 8, in which a part of said supply passage is interposed between said radiator and said fan for cooling the oil passing through said supply passage.

10. An engine cooling system for use in an automobile, comprising:

(a) an engine having an output shaft;

(b) a radiator;

(c) a cross-flow fan disposed adjacent to said radiator and having a rotatable shaft;

(d) a hydraulic motor coupled to said rotatable shaft of said cross-flow fan;

(e) a hydraulic pump driven by said output shaft of the engine and connected to said hydraulic motor for supplying oil under pressure to the hydraulic motor to rotate said rotatable shaft of the cross-flow fan;

(f) a return passage interconnecting said hydraulic motor and said hydraulic pump;

(g) a supply passage interconnecting said hydraulic pump and said hydraulic motor;

(h) a movable shroud for controlling a flow of air toward said cross-flow fan;

(i) a radiator shutter disposed between said radiator and said cross-flow fan; and (j) hydraulic means connected between said supply passage and said return passage for actuating said radiator shutter and said movable shroud, respectively.

* * * * *